United States Patent [19]

Komanecky

[11] Patent Number: 4,828,226

[45] Date of Patent: May 9, 1989

[54] TAP HOLE PLUGS FOR METALLURGICAL VESSELS

[75] Inventor: Richard J. Komanecky, Strongsville, Ohio

[73] Assignee: Foseco International Limited, Birmingham, England

[21] Appl. No.: 109,172

[22] Filed: Oct. 16, 1987

[51] Int. Cl.[4] ..... C21B 7/12

[52] U.S. Cl. ..... 266/45; 266/272; 222/597

[58] Field of Search ..... 266/45, 271, 272, 273, 266/280, 287; 222/597

[56] References Cited

U.S. PATENT DOCUMENTS

| | | | |
|---|---|---|---|
| 3,776,532 | 12/1973 | Imberti | 266/272 |
| 4,471,950 | 9/1984 | LaBate | 266/271 |
| 4,556,097 | 12/1985 | Burmeister | 222/597 |

FOREIGN PATENT DOCUMENTS

| | | |
|---|---|---|
| 0046473 | 3/1982 | European Pat. Off. . |
| 3437810 | 4/1986 | Fed. Rep. of Germany . |
| 80051005 | 10/1978 | Japan . |
| 1184466 | 3/1970 | United Kingdom . |
| 1368195 | 9/1974 | United Kingdom . |
| 1515629 | 6/1978 | United Kingdom . |

OTHER PUBLICATIONS

Henson, *Special Refractories,* American Foundryman, pp. 64–70, 5/47.

*Primary Examiner*—S. Kastler
*Attorney, Agent, or Firm*—Nixon & Vanderhye

[57] ABSTRACT

A plug for the tap hole of a metallurgical vessel includes a canister containing refractory mortar between a pair of end plates, one of which is movable toward the other to squeeze or compress the mortar through an aperture in a generally radially outward direction to seal against the tap hole wall. A plunger is provided and has axially relatively movable sleeves. One sleeve connects with the plug, while the other sleeve has a pusher head engageable against the movable end plate of the plug. The plug is connected to the plunger and inserted into the opening. The sleeves are axially displaced to cause the disks to relatively move axially toward one another, displacing the mortar into sealing engagement with the tap hole walls. Upon location and sealing of the tap hole by the plug, the plunger is unscrewed from the plug and withdrawn for later use.

20 Claims, 3 Drawing Sheets

FIG. 1
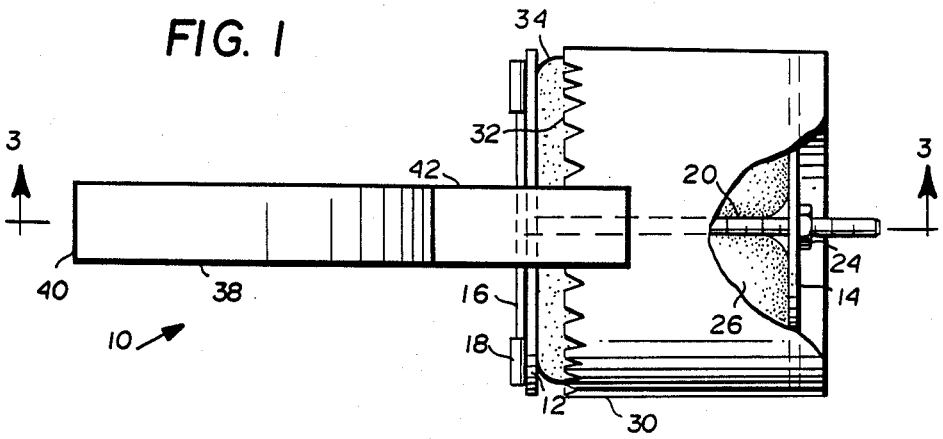
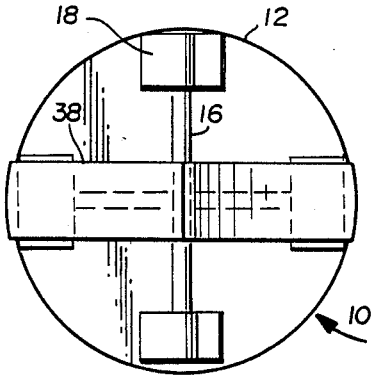
FIG. 2
FIG. 3
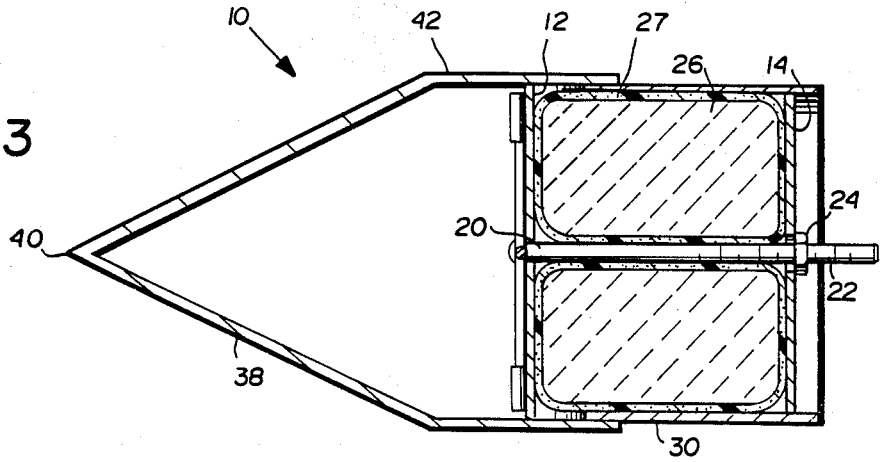

TAP HOLE PLUGS FOR METALLURGICAL VESSELS

BACKGROUND OF THE INVENTION

The present invention relates to a plug for the tap hole of a metallurgical vessel and particularly relates to a tap hole plug per se, as well as apparatus and methods for inserting the plug into the tap hole.

In metallurgical vessels, there is conventionally provided a tap hole through the side wall of the vessel and through which molten metal from the vessel may be poured when the vessel is pivoted about a horizontal axis. Tap holes are typically filled with a plug designed to seal the tap hole opening, notwithstanding contact between the tap hole plug and slag formed on top of the molten metal, and also to melt when in contact with the molten metal in order that the molten metal may be poured through the tap hole. In this manner, the slag remains in the vessel.

Generally, tap holes are subject to greater wear in use than the interior of the vessel lining. For example, the interior end of the tap hole tends to become conical in shape and the circularity of the tap hole often becomes irregular and distorted. In certain circumstances, tap holes have evolved through use into generally D-shaped openings with molten metal and slag depositing along the lower surfaces of the tap holes. That is to say, slag whiskers or occasional slag carry-over and molten metal stoppings often reduce the circular opening to a D shape. All of these irregularities render the tap holes difficult to plug using conventional tap hole plugs.

As will be appreciated, there are a substantial number of different types of tap hole plugs that have been proposed and constructed in the past.

However, none of these alleviate the problem of the irregular enlargement of the hole through use of afford plugs practical for use with non-circular openings. Furthermore, tap hole plugs are difficult to insert into the tap holes. For example, while tap holes are ordinarily of a diameter approximately 6 inches and a length on the order of about 4 feet, it is customary to stand back 10 to 15 feet from the tap hole and insert the plug. It is therefore very often difficult to guide the plug into the tap hole and secure it in place inasmuch as plug placement and securement are accomplished manually.

According to the present invention, there is provided a tap hole plug which is readily and easily inserted into the tap hole for sealing the hole adjacent the inner surface of the vessel.

Particularly, the plug comprises a canister containing refractory mortar, preferably zircon colloidal silica refractory mortar, disposed between a pair of end plates and about a central member extending between the end plates. The end plate nearer the outside of the vessel in which the plug is to be inserted is axially movable along the central member toward the opposite end plate to compress or apply a pressure to the refractory mortar disposed between the plates. The canister has a radially opening aperture which extends about the periphery of the canister. Consequently, upon compressing the mortar between the end plates, the mortar flows radially outwardly through the aperture to bear and seal against the walls defining the tap hole. Preferably, the canister is provided with a right angularly related V-shaped guide which projects from the forward end of the canister. This guide facilitates insertion of the plug into the tap hole from outside of the vessel by enabling the plug to be centered within the tap hole.

In order to insert the plug of the present invention into the tap hole, there is provided an applicator plunger. The plunger is formed of inner, outer and intermediate concentric sleeves. The inner and outer sleeves are secured one to the other against axial movement relative to one another by a pin which extends through diametrically opposed, longitudinally extending, slot formed in the intermediate sleeve. Thus, the intermediate sleeve is axially movable relative to both the inner and outer sleeves. The intermediate sleeve mounts a pusher head at one end, while the corresponding end of the inner sleeve is internally threaded for connection with a central member of the plug. The outer sleeve carries a laterally projecting stop for engagement with the outer wall of the vessel. The stop is located a predetermined distance from the pusher head determined by the thickness of the vessel wall, i.e., the length of the tap hole, and the desired location of the plug in the tap hole. The intermediate sleeve includes an encircling coil spring connecting it and the outer sleeve for biasing such sleeves for axial movement into a position where the pusher head and the connecting means lie substantially flush adjacent one end of the plunger.

When using the plunger, the central member of the plug is threaded to the end of the inner sleeve such that the plug may be carried with the plunger. Standing back 10 to 15 feet from the vessel and using an extension rod releasably secured to the rear end of the plunger, the operator then extends the plunger such that the guide on the plug enters the tap hole. The plug is sized to leave a small annular space between it and the walls defining the tap hole upon displacing the plug into the tap hole. Advancement of the plunger to insert the plug into the tap hole eventually causes the stop carried by the outer sleeve to butt against the outer surface of the vessel. When the plunger stops, the plug is properly located intermediate the ends of the tap hole short of the inner surface of the vessel. The intermediate sleeve carrying the pusher head is then advanced relative to the outer and inner sleeves. By advancing the pusher head against the movable end plate of the plug and advancing it toward the opposite end plate, the mortar between the end plates is compressed and forced radially outwardly to engage and seal against the walls of the tap hole. The heat of the furnace sets up the refractory mortar to seal the tap hole opening. It will thus be appreciated that the mortar is displaced radially outwardly similarly as an extrusion and fills the gap or annular space between the wall defining the tap hole and the plug. Consequently, the particular shape or irregularities in the sleeve of the tap hole is of little consequence in sealing the tap hole, provided the shape does not preclude entry of the plug into the tap hole. Once the plug has been located and sealed in the tap hole, the plunger is rotated to unthread the inner sleeve from the plug withdrawn from the tap hole.

In a preferred form of the present invention, zircon colloidal silica refractory mortar is used, although it will be appreciated that other types of mortar, including MgO, $Al_2O_3$ and silica, may be used.

Thus, in accordance with a present preferred embodiment of the invention, there is provided a plug for the tap hole of a metallurgical vessel comprising a canister for reception within the tap hole, the canister having an axis. A refractory mortar is carried by the canister and disposed about the axis. Means are provided for retaining the mortar in the canister precluding its displacement in a radially outward direction. Means are additionally carried by the canister for displacing the refractory mortar within the canister generally radially outwardly thereof when the canister is disposed in the tap hole to seal against the walls of the vessel defining the tap hole. Preferably, the canister has a pair of axially spaced end plates wherein one of the end plates is movable toward the other end plate to displace the mortar in a radial direction. A guide is provided in the canister, including a central member on which the movable plate is guided toward its opposite end plate in response to the pushing action of the pusher head.

According to the present invention, there is also provided apparatus for inserting a plug in a tap hole of a metallurgical vessel comprising a plunger having a pair of concentric sleeves axially movable relative to one another, a pusher head disposed adjacent one end of one of the sleeves for engaging the plug, together with means carried by the other sleeve adjacent a like end thereof as the one sleeve end for connecting the other sleeve and the plug one to the other whereby the pusher head and the connecting means may be axially displaced relative to one another. Preferably, inner, outer and intermediate sleeves are provided with the pusher head and connecting means being formed on the intermediate and inner sleeves, respectively. In a preferred form hereof, a stop is carried by the outer sleeve at a location spaced from the pusher for engaging the wall of the metallurgical vessel upon insertion of the pusher into the tap hole whereby the extent of insertion into the tap hole of the pusher may be limited, thereby properly locating the plug in the tap hole.

In accordance with another aspect of the present invention, there is provided a method of inserting a plug in the tap hole of a metallurgical vessel comprising the steps of providing a plug containing a refractory mortar, providing a plunger having a pair of concentric sleeves axially movable relative to one another, one sleeve having a plug connecting means at a like end thereof as the one sleeve, connecting the plug and the other sleeve one to the other, inserting the plug and at least a portion of the plunger into the tap hole and axially displacing the sleeves relative to one another to displace the mortar radially outwardly of the plug to fill the gap between the plug and the walls of the tap hole, thereby sealing the tap hole with the mortar.

Accordingly, it is a primary object of the present invention to provide a novel and improved plug for the tap hole of a metallurgical vessel which may be readily and easily inserted into the tap hole and which plug carries mortar which can be displaced radially to seal against the walls of the tap hole.

It is another object of the present invention to provide novel and improved apparatus and methods for inserting the plug into the tap hole.

These and further objects and advantages of the present invention will become more apparent upon reference to the following specification, appended drawings and claims.

BRIEF DESCRIPTION OF THE DRAWING FIGURES

FIG. 1 is a side elevational view of a tap hole plug constructed in accordance with the present invention with parts broken out for clarity;

FIG. 2 is an end elevational view of the tap hole plug illustrated in FIG. 1 and looking from left to right in FIG. 1;

FIG. 3 is a cross-sectional view of the tap hole plug taken generally about on line 3—3 in FIG. 2;

Figure 4:
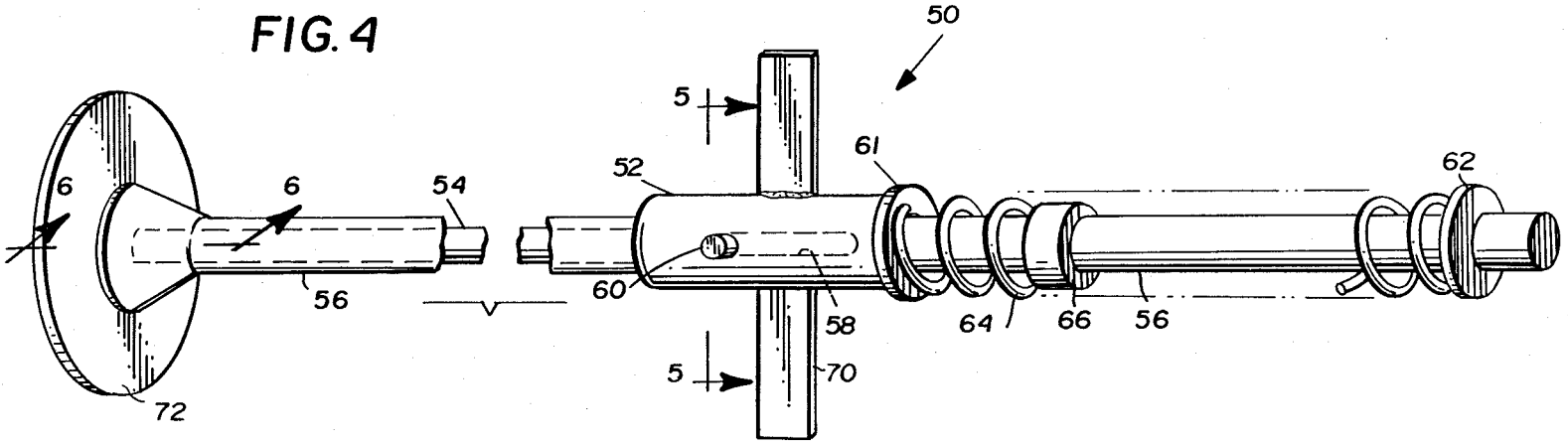
FIG. 4 is a perspective view of a plunger for use in inserting the tap hole plug of FIG. 1 into the tap hole.
Figure 6:
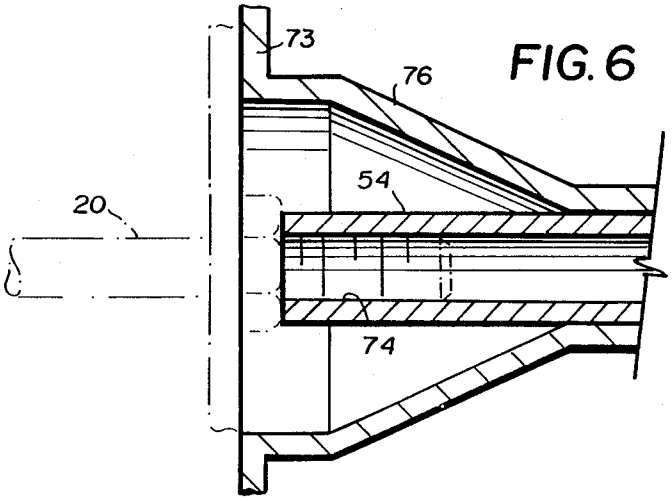
Figure 7:
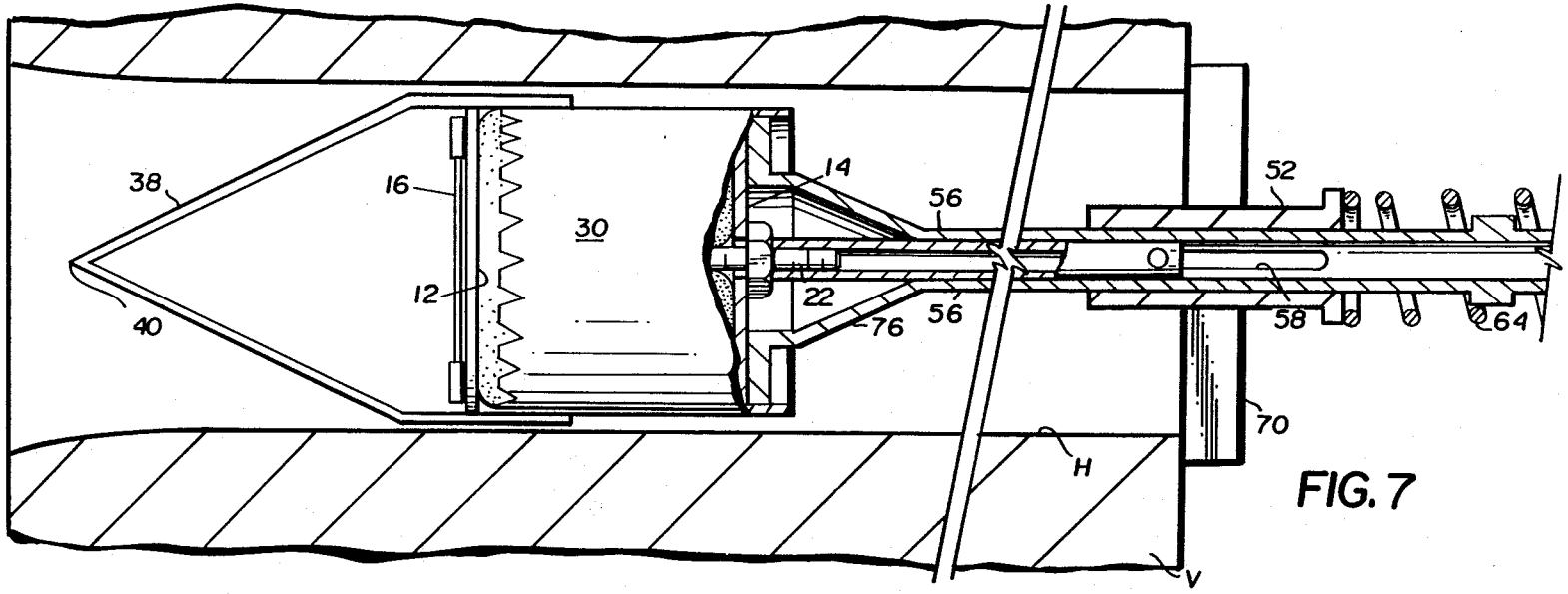
Figure 8:
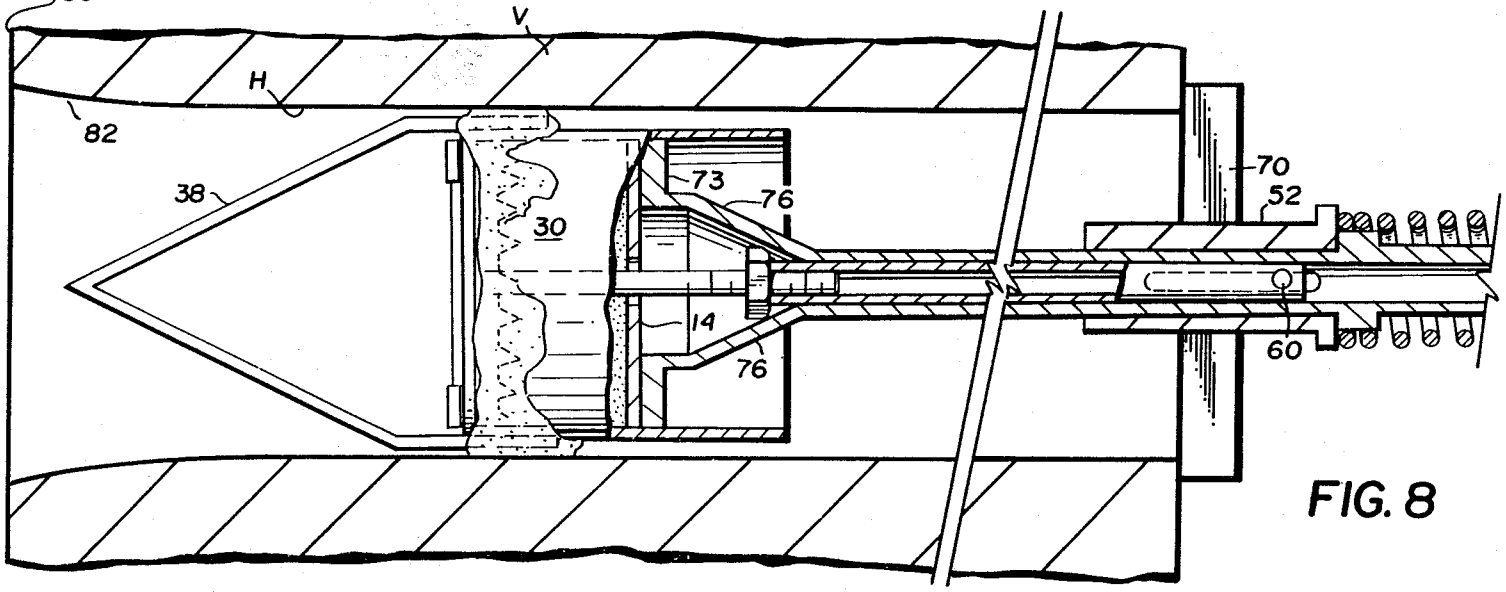

FIG. 6 is a longitudinal sectional view taken about on line 6—6 in FIG. 4 illustrating the location of the pusher head and the plug connecting means on the end of the inner sleeve; and FIGS. 7 and 8 are cross-sectional views illustrating the placement of the plug by the plunger in the tap hole prior to operating the plunger to displace the mortar and subsequent to displacing the mortar to seal the tap hole opening, respectively.

DETAILED DESCRIPTION OF A PREFERRED EMBODIMENT

Reference will now be made in detail to the present preferred embodiment of the invention, an example of which is illustrated in the accompanying drawings.

Referring now to FIG. 1, there is illustrated a tap hole plug constructed in accordance with the present invention comprising a generally cylindrical canister generally designated 10. Tap hole plug 10 comprises a pair of end plates or disks 12 and 14, respectively, spaced axially one from the other. The forwardmost disk 12 has a pair of crossed reinforcing rods 16 disposed along its forward face. As illustrated in FIG. 2, clamps 18 are welded or otherwise secured to the outside face of disk 12 to secure the ends of the rods along the outside face of disk 12. A central member or rod 20 extends rearwardly from disk 12 and is received through a central opening in disk 14. Disk 14 is therefore mounted for longitudinal sliding movement along central member 20. Member 20 terminates in an externally threaded end 22 which projects beyond the end of a nut 24, the latter serving to retain disk 14 on the canister.

Disposed between end plates 12 and 14 about central member 20 and within the circular confines of the canister 10 is refractory mortar 26. In the illustrated form, refractory mortar 25 is in the shape of an annulus, with central member 20 extending through the open center portion of mortar annulus 26. A suitable plastic covering 27 is disposed about the mortar. The refractory mortar may be of any well known type and preferably comprises a zircon colloidal silica refractory mortar. Canister 10 is circumscribed by a generally circular housing or wall 30. Disk 14 is slidable within wall 30 at the rear end of the plug, while the forward edge 32 of wall 30 is spaced axially rearwardly from the forward disk 12. In this manner, edge 32 of wall 30 defines with disk 12 a peripheral, generally radially extending, aperture 34. The forward edge of wall 30 is preferably serrated or grooved.

To secure wall 30 in canister 10, as well as to guide the canister into the tap hole as described hereinafter, a generally V-shaped metal guide 38 projects from the forward end of canister 10. Particularly, metal guide 38 comprises a pair of metal strips terminating at an apex 40 at one end and leg portions 42 at its opposite end which extend along opposite side portions of plug 10. The wall 30 and leg portions 42 are suitable secured one to the other whereby the mortar 26 is retained within the canister within the wall 30. It will be appreciated that guide 38 projects forwardly and serves to center the plug in the tap hole opening when initially applied to the opening in a manner described hereinafter.

Figure 5:
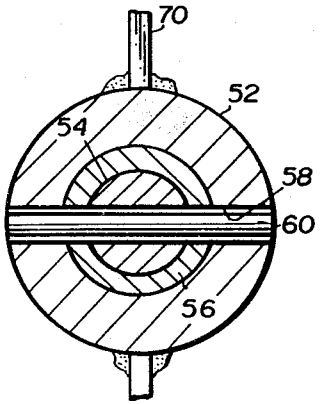
FIG. 5 is an enlarged cross-sectional view thereof taken generally about on line 5—5 in FIG. 4.

Referring now to FIG. 4, there is illustrated a plunger, generally designated 50, for use in applying the plug 10 into the tap hole. Particularly, plunger 50 preferably comprises outer, inner and intermediate members or sleeves 52, 54 and 56, respectively. Sleeves 54 and 56 are longer than outer sleeve 52 and may, for example, extend upwards of 7 feet. As illustrated in FIGS. 4 and 5, intermediate sleeve 56 has a pair of longitudinally extending, diametrically opposed, slots 58 intermediate its ends. Outer sleeve 52 and inner sleeve 54 are secured one to the other against relative axial movement by a pin 60 which extends through slot 58 of intermediate sleeve 54. Consequently, outer and inner sleeve 52 and 54, respectively, are fixed against axial movement relative to one another, whereas intermediate sleeve 56 may move axially relative to outer and inner sleeves 52 and 54, respectively.

As best seen in FIG. 4, a collar 61 is formed adjacent the rear end of the outer sleeve 52 and a corresponding collar 62 is provided on intermediate sleeve 56 rearwardly of outer sleeve 52 and spaced from collar 61. A helical coil spring 64 extends between collars 61 and 62 biasing the intermediate sleeve 56 for movement in a direction, for example, left to right as illustrated in FIG. 4, relative to outer sleeve 52. Consequently, the pin 60 normally engages in the forward end of slot 58. For reasons which will be apparent from the ensuring description, an enlarged diameter portion 66 is formed on the outer surface of intermediate sleeve 56 such that, upon displacement of intermediate sleeve 56 relative to outer sleeve 52, for example, from right to left against the bias of spring 64, the enlarged portion 66 may butt collar 61, thereby serving as a stop to limit axial movement of intermediate sleeve 56 in the opposite direction. In this manner, pin 60 is not subjected to shear stress when intermediate sleeve 56 reaches the extreme end of its axial displacement relative to outer sleeve 52.

As best seen in FIGS. 4 and 5, outer sleeve 52 is provided with a stop. Particularly, the stop includes a laterally projecting bar 70. The length of bar 70 exceeds the diameter of the tap hole by a substantial margin. In this manner, stop 70 may be engaged against the outer surface of the vessel adjacent the margin of the tap hole, thereby to limit the extent of insertion of the forward portion of the plunger into the tap hole in a manner to be explained.

As illustrated in FIGS. 4 and 6, the end of intermediate sleeve 56 is provided with a pusher head 72. Pusher head 72 comprises an enlarged diameter circular disk 73 smaller in diameter than the diameter of the tap hole and of a diameter for reception within the housing 30 for bearing against the rear end wall or disk 14 of plug 10. Additionally, as seen in these figures, the corresponding end of inner sleeve 54 terminates in an internally threaded opening 74. It will be appreciated from a review of these drawings that, in the retracted position of the plunger as illustrated, the internally threaded end 74 of inner sleeve 54 and pusher head 72 mounted on intermediate sleeve 56 lie substantially flush one with the other. Also, pusher head 72 flares at 76 at its juncture with intermediate sleeve 56 to accommodate the nut 24 on plug 10, as will be apparent from the ensuing description.

In using the plug and plunger of the present invention, plug 10 is first secured to the end of the plunger. Particularly, the exposed portion 22 of the externally threaded end of central member 20 is threaded into the internally threaded end 74 of inner sleeve 54, thereby mounting plug 10 on the end of plunger 50 with pusher head 72 bearing against movable end disk 14. Once the plug is secured to the plunger, an extension rod, not shown, is attached to the opposite end of the plunger such that the operator may stand back 10–15 feet from the tap hole. The extension rod and plunger are then manipulated such that the apex 40 of guide 38 is received in the tap hole. The inclined surfaces of guide 38 center the plug in the tap hole as the plug is pushed further into the tap hole opening. Thus, the plunger is advanced axially without relative movement between the sleeves until stop 70 butts against the outer wall surface of the metallurgical vessel V (FIGS. 7 and 8) surrounding the tap hole H. Because the distance between stop 70 and pusher head 72 is known and the plunger is therefore formed to provide a predetermined distance corresponding to the depth of the tap hole and the desired location of the plug within the tap hole, once stop 70 butts vessel V, plug 10 is located in its predetermined final position, as illustrated in FIG. 7. It will be appreciated that because the plug is of smaller diameter than the walls defining the tap hole, the plug may be readily and easily inserted into the tap hole notwithstanding local variations and irregularities in the surface of the walls defining tap hole H.

To seal tap hole H, intermediate sleeve 56 is axially advanced relative to outer sleeve 52 and inner sleeve 54 as illustrated in FIG. 8. It will be appreciated that the refractory mortar 26 within plug 10 is of such consistency, when heated by the heat of the vessel V, as to be able to flow when compressed. By holding inner sleeve 54 and, hence, the forward disk 12 in fixed position, and advancing intermediate sleeve 56 relative to inner sleeve 54, rear end disk 14 is axially displaced toward fixed disk 12. In this manner, refractory mortar 26 within housing 30 is displaced and flows through aperture 34 in a direction generally radially of the plug and substantially about its entire surface. Consequently, the mortar is displaced into sealing engagement with the walls of the tap hole about the plug. Once the plug has been located in position and the mortar has set up to seal the tap hole, the plunger may be rotated to unthread inner sleeve 54 from central member 20 of the plug. The plunger may then be withdrawn from vessel V with the assurance that the plug has been located adjacent the inner surface 80 of the vessel in proper position adjacent the worn flared end 82 of the tap hole H, and lies in sealing engagement against the walls defining the tap hole. The plunger is then withdrawn for later use. The plug 10 then serves in the manner of conventional plugs. That is, plug 10 will melt when in contact with the molten metal in the metallurgical vessel V upon inclination thereof whereby the molten metal may be poured through the tap hole opening. The foregoing described process of sealing the tap hole may then be repeated using the plunger having a new plug attached thereto.

It will be appreciated that the objects of the present invention have been fully accomplished. Particularly, there has been provided a plug which is readily and easily inserted into the tap hole by a unique plunger apparatus. Particularly, the plug and plunger cooperate to radially expand or extrude the refractory mortar into the gap between the plug and the tap hole walls to fill and seal the tap hole. The expansion or displacement of the mortar in a radial direction is accomplished by manipulation of the plunger from a location externally of the vessel. The plunger may be readily disconnected from the plug once in place and reused for inserting additional plugs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A plug for the tap hole of a metallurgical vessel, comprising:

a canister for reception within the tap hole and having an axis;

a refractory mortar carried by said canister and disposed about said axis;

means for retaining said mortar in said canister precluding displacement thereof in a radial outward direction;

means carried by said canister for displacing the refractory mortar within the canister generally radially outwardly thereof when the canister is disposed in the tap hole to seal against the walls of the vessel defining said tap hole; and said displacing means including a pair of end plates spaced axially one from the other with said mortar being disposed therebetween, at least one of said end plates being movable toward the other of said end plates to displace the mortar in said radial direction.

2. A plug according to claim 1 including means carried by said canister for guiding said movable end plate toward the opposite end plate.

3. A plug according to claim 1 wherein said retaining means includes an outer housing encompassing at least part of said mortar retained within said canister, said canister having at least one aperture extending substantially about the entire periphery of said housing such that the mortar may be displaced through said aperture in a radial direction substantially about the entire periphery of said canister.

4. A plug according to claim 3 including means carried by said canister for guiding the one end plate for movement toward the other end plate including a central member, and means carried by said central member for retaining the movable plate on said canister.

5. A plug according to claim 1 including a means projecting from one end of said canister for guiding the canister for movement through the tap hole.

6. A plug according to claim 1 wherein said mortar comprises a zircon colloidal silica refractory mortar.

7. Apparatus for inserting a plug in the tap hole of a metallurgical vessel, comprising:

a plunger having concentric elongated inner, outer and intermediate members;

means connected between said inner and outer members for preventing axial movement thereof relative to one another, said intermediate member being axially movable relative to said inner and outer members;

means cooperable between at least one of said inner and said outer members and said intermediate member for limiting axial movement of said intermediate member relative thereto;

a pusher head disposed adjacent one end of said intermediate member for engaging the plug; and means carried by said inner member for connecting said inner member and the plug one to the other whereby said pusher head may be axially advanced beyond the end of said inner member while said inner member remains connected to the plug.

8. Apparatus according to claim 7 including a stop carried by said outer member at a location spaced from the pusher for engaging the wall of the metallurgical vessel upon insertion of said pusher into the tap hole whereby the extent of insertion into the tap hole of the pusher may be limited.

9. Apparatus according to claim 7 wherein said connecting means between said inner and outer members includes a slot formed in said intermediate member and a pin connected between said inner and outer members and extending through said slot to enable axial sliding movement of said intermediate member relative to said inner and outer members.

10. Apparatus according to claim 7 including means carried by said plunger for biasing said intermediate member for axial movement relative to said outer member in a direction toward the opposite end of said plunger.

11. Apparatus according to claim 7 in combination with said plug, means carried by said plug cooperable with the latter connecting means for connecting said plug and said plunger one to the other.

12. Apparatus according to claim 11 wherein said plug carries a refractory mortar between a pair of spaced end elements, one of said end elements being connected to said inner member while the other of said members is engaged by said pusher whereby the mortar between said members may be compressed therebetween in response to relative axial movement of said intermediate and inner members.

13. Apparatus according to claim 7 in combination with the plug for the tap hole of the metallurgical vessel, said plug including a canister for reception within the tap hole and having an axis, a refractory mortar carried by said canister and disposed about said axis, means for retaining said mortar in said canister precluding displacement thereof in a radial outward direction, said canister having at least one aperture opening generally radially thereof, means carried by said canister for displacing the refractory mortar within the canister generally radially outwardly thereof through said aperture to seal against the walls of the vessel defining said tap hole.

14. Apparatus for inserting a plug in the tap hole of a metallurgical vessel, comprising:

a plunger having a pair of elongated concentric members axially movable relative to one another;

a pusher head disposed adjacent one end of one of said members for engaging the plug; and means carried by the other of said members adjacent a like end thereof as said one member end for connecting said other member and the plug one to the other whereby said pusher head and said connecting means may be axially displaced relative to one another.

15. Apparatus according to claim 14 in combination with the plug, said plug comprising a canister and refractory mortar carried by said canister, means carried by said canister for applying pressure to the mortar to displace the mortar in a generally radially outward direction, said pressure applying means being engageable with said pusher and said connecting means to displace said mortar radially in response to said axial displacement of said sleeves.

16. A method for inserting a plug in the tap hole of a metallurgical vessel comprising the steps of:

providing a plug containing a refractory mortar;

providing a plunger having a pair of concentric elongated members axially movable relative to one another, one member having a pusher at one end and the other member having plug connecting means at a like end thereof as said one member;

connecting said plug and said other member one to the other;

inserting said plug and at least a portion of the plunger into the tap hole; and axially displacing said members relative to one another to displace the mortar radially outwardly of said plug to fill the gap between the plug and the walls of the tap hole thereby sealing the tap hole with the mortar.

17. A method according to claim 16 including providing a stop on said plunger and inserting said plunger portion into said tap hole such that the stop engages the outer wall of the vessel thereby limiting the extent of the penetration of the plug into the tap hole.

18. A method according to claim 16 including disconnecting said plug and said other sleeve after said mortar has been displaced radially outwardly to seal the tap hole.

19. A method according to claim 16 including inserting said plug into the tap hole from the outside of the vessel and to an extent short of the interior surface of the vessel such that the plug seals the tap hole intermediate its opposite ends.

20. A method according to claim 16 wherein said members comprise inner and outer sleeves, respectively.

* * * * *